United States Patent [19]

Hibbard

[11] Patent Number: 4,702,053

[45] Date of Patent: Oct. 27, 1987

[54] COMPOSITE INSULATED WALL

[75] Inventor: Donald B. Hibbard, Akron, Ohio

[73] Assignee: Hibbard Construction Co., Akron, Ohio

[21] Appl. No.: 877,537

[22] Filed: Jun. 23, 1986

[51] Int. Cl.[4] ..... E04C 2/22; E04C 2/26

[52] U.S. Cl. ..... 52/309.7; 52/309.12; 52/405; 52/410; 52/712

[58] Field of Search ..... 52/309.4, 309.7, 309.11, 52/309.12, 309.17, 404, 410, 664, 405, 712–714; 249/219 W

[56] References Cited

U.S. PATENT DOCUMENTS

| | | | |
|---|---|---|---|
| 845,635 | 2/1907 | Ham | 249/219 W X |
| 2,063,309 | 12/1936 | Graef . | |
| 2,613,424 | 10/1952 | Kenny | 249/219 W X |
| 2,653,469 | 9/1953 | Callan . | |
| 3,494,088 | 2/1970 | Rorner . | |
| 3,672,022 | 6/1972 | York | 52/664 X |
| 3,879,908 | 4/1975 | Weismann . | |
| 4,117,639 | 10/1978 | Steenson et al. . | |
| 4,157,640 | 6/1979 | Joannes | 52/309.7 |
| 4,226,067 | 10/1980 | Artzer | 52/309.12 |
| 4,329,821 | 5/1982 | Long et al. . | |
| 4,336,676 | 6/1982 | Atzer . | |
| 4,393,635 | 7/1983 | Long . | |
| 4,489,530 | 12/1984 | Chang | 52/309.12 X |
| 4,624,089 | 11/1986 | Dunker | 52/309.12 |

*Primary Examiner*—William F. Pate, III
*Assistant Examiner*—R. Chilcot
*Attorney, Agent, or Firm*—Raymond D. Thompson

[57] ABSTRACT

There is disclosed a reinforced, insulated concrete laminated wall. The central portion is a rigid insulation core through which vertical ladder structures extend transversely. Matched pairs of horizontal braces extend parallel to and abut the insulation core to hold it firmly in place. The horizontal braces rest on the rungs of the transverse vertical ladders and may be locked down to the rungs to prevent movement during concrete pouring. The wall is manufactured by positioning the core, ladders and braces medially between suitable forms. A single stage pour of concrete is then made to form the complete wall without resetting the forms. The wall may be constructed directly on a building foundation or prefabricated and subsequently positioned on the foundation.

9 Claims, 6 Drawing Figures

COMPOSITE INSULATED WALL

BACKGROUND OF THE INVENTION

This invention relates to building walls and, in particular, to insulated walls having outer layers of poured concrete and an inner layer of rigid insulation therebetween. It is well known in the industry to utilize a pair of opposed parallel outer layers of concrete with an inner layer of cellular insulation, provided for the purpose of improving the insulating efficiency of the poured wall. U.S. Pat. Nos. 2,653,469 and 4,329,821 disclose such walls. A long sought after, but heretofore unfulfilled, objective in the manufacture of such insulated concrete walls is the ability to pour the concrete into the forms with a single concrete pouring step. U.S. Pat. No. 4,329,821 sets out one attempt to achieve a single stage pour. A spaced series of pins or tie rods extend through the insulating layer and are of sufficient length to barely touch the opposed forms. Each pin or tie rod includes a pair of washers which are positioned directly adjacent the outer surface of the insulation wall to prevent shifting of the pin during concrete pouring. The success of this method is dependent upon the uniformity of the concrete pouring step on each side of the insulation and on the inherent strength of the insulation panel. This method provides inconsistent support using a single stage pour, due to the localized support provided by the spaced apart tie rods or pins. When the concrete accumulates more quickly on one side of the insulation, the insulation board has a tendency to shift despite the presence of those pins. The placement of the individual pins and washers at a multiplicity of locations on the insulation board is labor intensive. Further, the system disclosed in U.S. Pat. No. 4,329,821 is not useful for walls having angles and corners, since the pins must have abutting forms on both sides for transverse placement. It also does not provide a reinforced wall structure, particularly when non-metallic pins or tie rods are utilized.

It is an object of the present invention to provide an efficient method of securely positioning insulation panels between the concrete forms. It is a further object of the invention to provide a reinforced, insulated wall structure using a single step concrete pouring method. Yet another object is to provide a composite, insulated, concrete wall in which the layers are bonded together by transverse reinforcing members to provide a monolithic wall structure upon completion.

BRIEF DESCRIPTION OF THE INVENTION

The above objects and advantages are achieved in a concrete insulated composite wall of predetermined vertical height, horizontal length and transverse width comprising:

(a) an insulation core having a predetermined thickness and extending the full horizontal length and vertical height of said wall and having a plurality of individual insulation panels;

(b) a continuous outer concrete layer on a first side of said insulation core;

(c) a continuous inner concrete layer on a second side of said insulation core;

(d) a plurality of vertical ladders positioned transversely of said insulation core and extending between adjacent individual insulation panels and extending the predetermined vertical height of said wall, each vertical ladder having a pair of parallel vertical members and a plurality of cross members spaced vertically apart and rigidly connected on each end to the parallel vertical members, said vertical ladder having a width less than the predetermined transverse width of the wall and greater than the transverse width of said insulation core:

(e) a plurality of horizontal ladders compressively positioned between said vertical members of said vertical ladder and said insulation core, each of said horizontal ladders having a vertical dimension less than the transverse dimension when positioned parallel to said cross member of said vertical ladder and having a multiplicity of openings along its horizontal length to allow communication and flow through said openings:

(f) a means for preventing vertical movement of said horizontal ladders relative to said cross member of said vertical ladder;

(g) said vertical ladder having a transverse dimension substantially equal to the thickness of the insulation core plus twice the transverse dimension of said horizontal ladders.

An efficient method of pouring a composite, insulated, concrete wall is achieved by a method of forming a reinforced, insulated concrete wall of predetermined thickness and length having an insulation core medially positioned between a pair of flanking concrete layers, said wall having a lengthwise direction, said method comprising the steps of:

(a) putting a first planar insulation core panel of determined length medially of said predetermined thickness, said planar insulation panel being oriented parallel to the lengthwise direction of the wall;

(b) placing a first vertical ladder at the end of said insulation panel perpendicular to the lengthwise direction of the wall and a second vertical ladder at the other end of said insulation panel, parallel to the first vertical ladder, said first and second vertical ladders each having a plurality of cross members connecting a pair of parallel vertical members;

(c) sliding a pair of horizontal ladders in the lengthwise direction along opposite sides of said insulation panel until said pair of horizontal ladders extends beyond said first and second vertical ladders, said horizontal ladders having a width substantially equal to the distance between the insulation panel and one of said pair of parallel vertical members;

(d) positioning said pair of horizontal ladders between the first and second vertical ladders on opposite sides of said insulation panel to abuttingly engage the insulation panel and the vertical member of said vertical ladder, said horizontal ladders being supported below by one of said plurality of cross members of the first and second vertical ladders;

(e) fastening said horizontal ladders to said vertical ladders by a means for preventing vertical movement of said horizontal ladders;

(f) repeating steps c through e on each of said plurality of cross members of said first and second vertical ladders;

(g) repeating steps a through f successively with additional insulation panels until the wall is of said predetermined length;

(h) setting a plurality of opposed pairs of concrete forms on opposing sides of said insulation panels, spaced apart by said predetermined thickness;

(i) pouring concrete to simultaneously fill the spaces between the forms and the insulation panels;

(j) allowing said concrete to set to form said reinforced, insulated concrete wall of said predetermined thickness and length; and (k) removing said concrete forms.

DETAILED DESCRIPTION OF THE INVENTION

Figure 1:
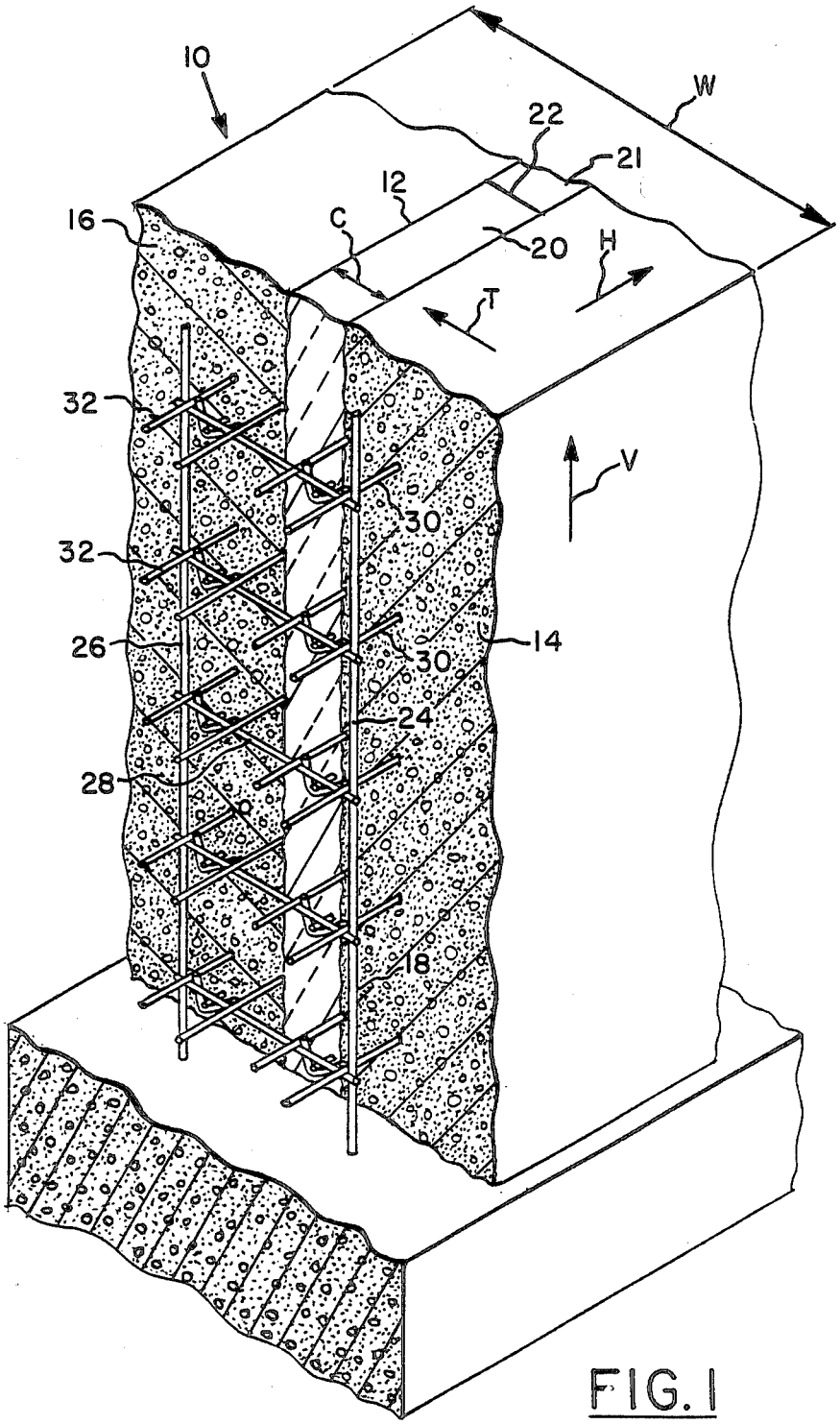
FIG. 1 is a fragmentary perspective view of a composite, insulated wall of the invention utilizing opposed horizontal ladders which abut directly opposing portions of the insulated panel of the wall.

Throughout the specification and claims, orientations and directions are directed to the wall as it is positioned on the building foundation. FIG. 1 shows the general orientation. The horizontal direction indicated by arrow H is also referred to occasionally as the lengthwise direction of the wall. The vertical direction labeled as V, corresponds to the height of the wall. The transverse direction labeled as T, corresponds to the thickness of the wall. Vertical, horizontal or transverse dimensions are always measured in the aforementioned directions.

Figure 2:
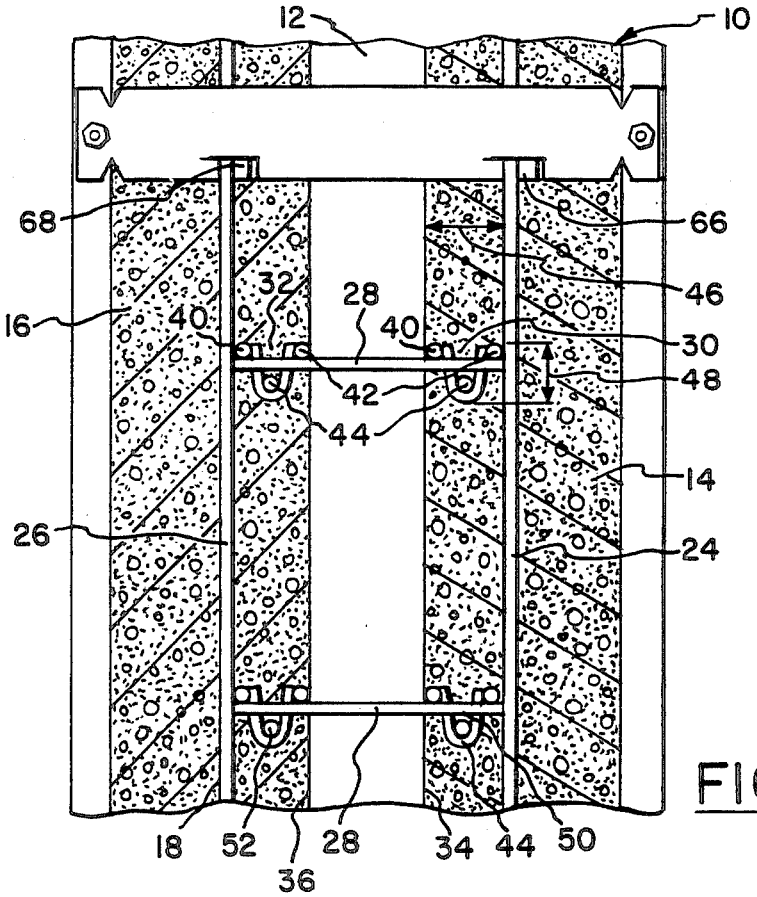
FIG. 2 is a fragmentary sectional view of the wall taken transversely of the wall prior to removal of the forms.

FIGS. 1 and 2 illustrate the composite wall of the invention. The composite wall 10 is composed of a center insulation core 12 which is flanked on either side by concrete layers 14,16. The insulation core 12 and concrete layers 14,16 extend the entire horizontal length and vertical height of the wall 10. The insulation core 12 is comprised of a plurality of individual panels. The insulation core 12 may be composed of any suitable insulating material which forms a relatively rigid, planar structure. Low thermal conductivity is the primary requirement. Foam or cellular polyurethane and polystyrene are preferred materials. The higher density foams form a more rigid structure while maintaining the low thermal conductivity property and are most preferred. The insulation core 12 is composed of individual panels 20,21 placed successively along the horizontal length of the wall. The interface between each panel 20, 21 must be a tightly abutting junction such that no substantial thermal leakage can occur. At each interface between the panels 20,21 there is a transversely positioned vertical ladder 18 which extends through the junction 22 between individual insulation panels 20,21. As shown in FIG. 1 and in greater detail in FIG. 2, the vertical ladders 18 extend for the full vertical height of the wall section and less than the transverse width of the wall. Each vertical ladder 18 is a rigid structure composed of a pair of parallel, vertical members 24,26 extending the full vertical height of the wall 10. A plurality of rigid cross members 28 extend between the vertical members 24,26 and are spaced apart along the vertical height of the vertical ladder 18. Each vertical ladder is greater than the transverse width C of the insulation core 12 and less than the transverse thickness W of wall 10. Thus, the vertical members 24,26 extend upwardly through the concrete layers 14,16 to provide reinforcement. The cross member 28 links the concrete layers 14,16 together to form a monolithic composite structure. The cross members 28 may be non-metallic rods having thermal conductivity less than steel to minimize thermal leakage through the insulation core. The cross members 28 may be vertically spaced evenly along the vertical height of the vertical ladder 18. However, it is preferred that the spacing of the cross members 28 be less near the bottom of the wall 10 in order to assist the insulation core in resisting the increasing weight of the overlying concrete layers 14,16 during the pouring operation. It is immediately clear to one of skill in the art that a one meter high wall would require fewer cross members 28 than a two or three meter high wall.

Horizontal ladder 30 is compressively fit between the vertical member 24 of the vertical ladder 18 and the insulation core 12 to provide lateral support to the insulation core and to prevent any transverse movement of the insulation core during the pouring of the concrete layers 14,16. The lateral support is ideally provided as shown in FIGS. 1 and 2 by pairs of horizontal ladders 30,32 positioned against the opposite lateral surfaces 34,36 of the insulation core 12.

Figure 6:
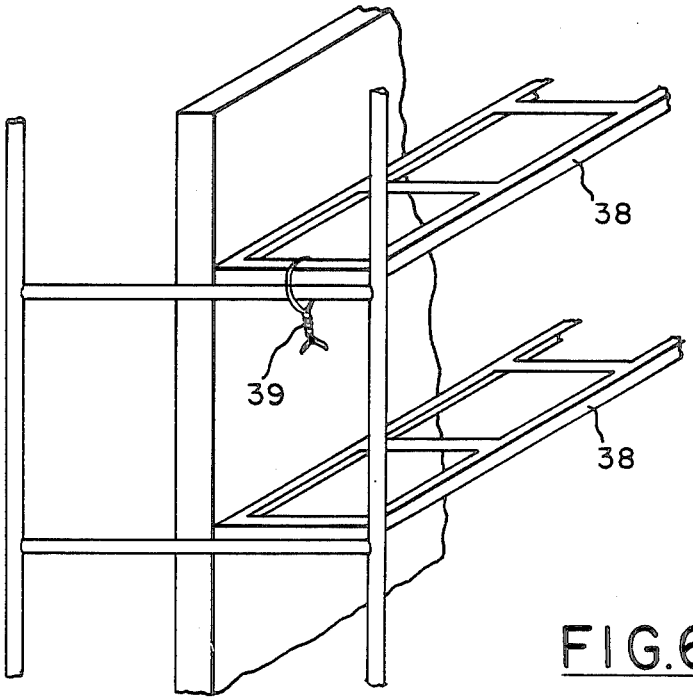
FIG. 6 shows an embodiment of the horizontal ladder which is a simple, flat ladder.

The horizontal ladder may assume a variety of shapes including the simplest shown in FIG. 6 as a flat, elongated ladder 38 which can be inserted on end and then flattened to compressively engage the insulation core. The ladder 38 is secured by wire ties 39 to prevent vertical movement. A simple reinforcing bar could also be used, but it adds very little reinforcement to the structure since it is directly adjacent to the insulation panel.

Figure 3:
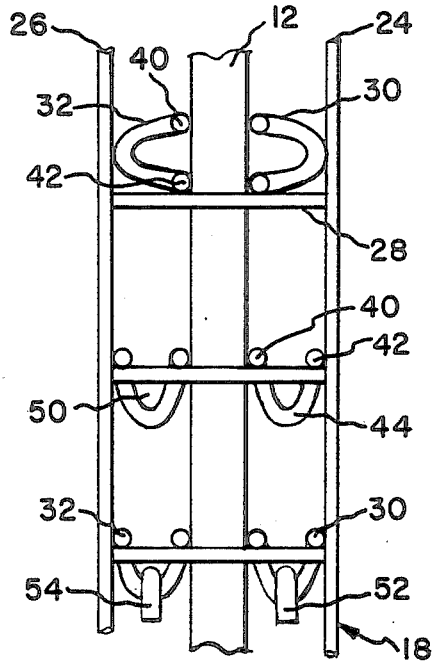
FIG. 3 illustrates the progression of steps of positioning the horizontal ladders. From top to bottom, the horizontal ladder is first inserted between the vertical ladder and insulating panel. The ladder is then rotated into engagement between the vertical ladder and insulating panel. At the bottom, the horizontal ladder is locked into position by insertion of a lock pin between the V shaped cross member of the horizontal ladder and the transverse member of the vertical ladder.

A more preferred form of the horizontal ladder is illustrated in FIGS. 1 and 2. The ladders 30,32 are composed of a pair of lengthwise extending rods 40,42 connected by a plurality of transverse members 44. A requirement of the horizontal ladder of any suitable configuration such as 30 is that the transverse dimension 46 must be less than the vertical dimension 48. This dimensional relationship is necessary to assure that the horizontal ladders may be easily inserted and then rigidly engaged between the vertical members 24,26 and the insulation core 12. The transverse dimension 46 must be substantially equal to the distance between the vertical member 24 of the vertical ladder 18 and the insulation core outer wall 34. A preferred form of the transverse members 44 is shown in FIGS. 2 and 3 as a V or U shaped cross section when viewed in a transverse cross section. It is preferred that the V shaped transverse member 44 extend below the cross member 28 of the vertical ladder to expose a U shaped or V shaped aperture 50 between the transverse member 44 and the cross member 28. It is apparent that in order to facilitate concrete flow through the horizontal ladder, the transverse members 44 must be widely spaced along the horizontal dimension H of the horizontal ladders 30,32.

FIG. 3 illustrates the progression of steps of positioning the horizontal ladders 30,32. From top to bottom, the horizontal ladders 30,32 are first inserted between the vertical ladder 18 and insulation core 12 with the lengthwise extending rods 40,42 sliding parallel to the panel 12. The ladders 30,32 are then rotated into engagement between the vertical ladder 18 and insulation core 12. At the bottom, the horizontal ladders 30,32 are locked into position by insertion of lock pins 52,54 between the V shaped cross member 44 of the horizontal ladders 30,32 and the transverse member 28 of the vertical ladder 18.

The horizontal ladders must be provided with a means for preventing vertical movement of the ladder or dislocation of the lengthwise rods 40,42 from their lockdown position resting upon the cross member 28 of the vertical ladder 18. FIG. 3 shows cross sectional detail of positioning of the horizontal ladders. The V shaped transverse members 44 of the horizontal ladder 30 extending below the cross member 28 forming the aperture 50 which provides a convenient means for preventing vertical movement. The term V shaped shall include any V shaped or other shape which forms an aperture 50 with the cross member. A lockpin 52,54 or any other suitable means for preventing movement between the cross member 28 and the V shaped transverse member 40 of the horizontal ladder 30 may be provided. It is understood that the means for preventing vertical movement may simply be a tiedown of wire or other suitable material as may be convenient. The term lockpin as used herein is meant to include any fastening structure which can be inserted through the aperture 50 and once inserted cannot be easily withdrawn. The lockpins 52,54 are most preferred fastening means in that they are quickly positioned and easily maintained in their position. The lockpins minimize the labor involved in this operation. The lockpins may be simple U or V shaped pins. They may also have a spring loaded flange that snaps into place after insertion similar to plasterboard anchors or toggle bolts.

Once the opposed horizontal ladders 30,32 are positioned on opposing sides of the insulation core 12, and the lockpins 54,52 are positioned as shown in FIG. 3, the insulation core is securely held in its medial position in the wall structure 10.

The method of manufacturing the composite wall of this invention can be best described by reference to FIG. 4 which shows the wall forms 60,62 in place prior to the pouring of concrete. In continuously forming the wall of this invention, the insulation core 12 is positioned medially between a pair of concrete forms 60,62. The vertical ladders 18 are set between adjacent panels of insulation 20,21 to extend transversely into the opening between the insulation core 12 and each concrete form 60,62.

Figure 4:
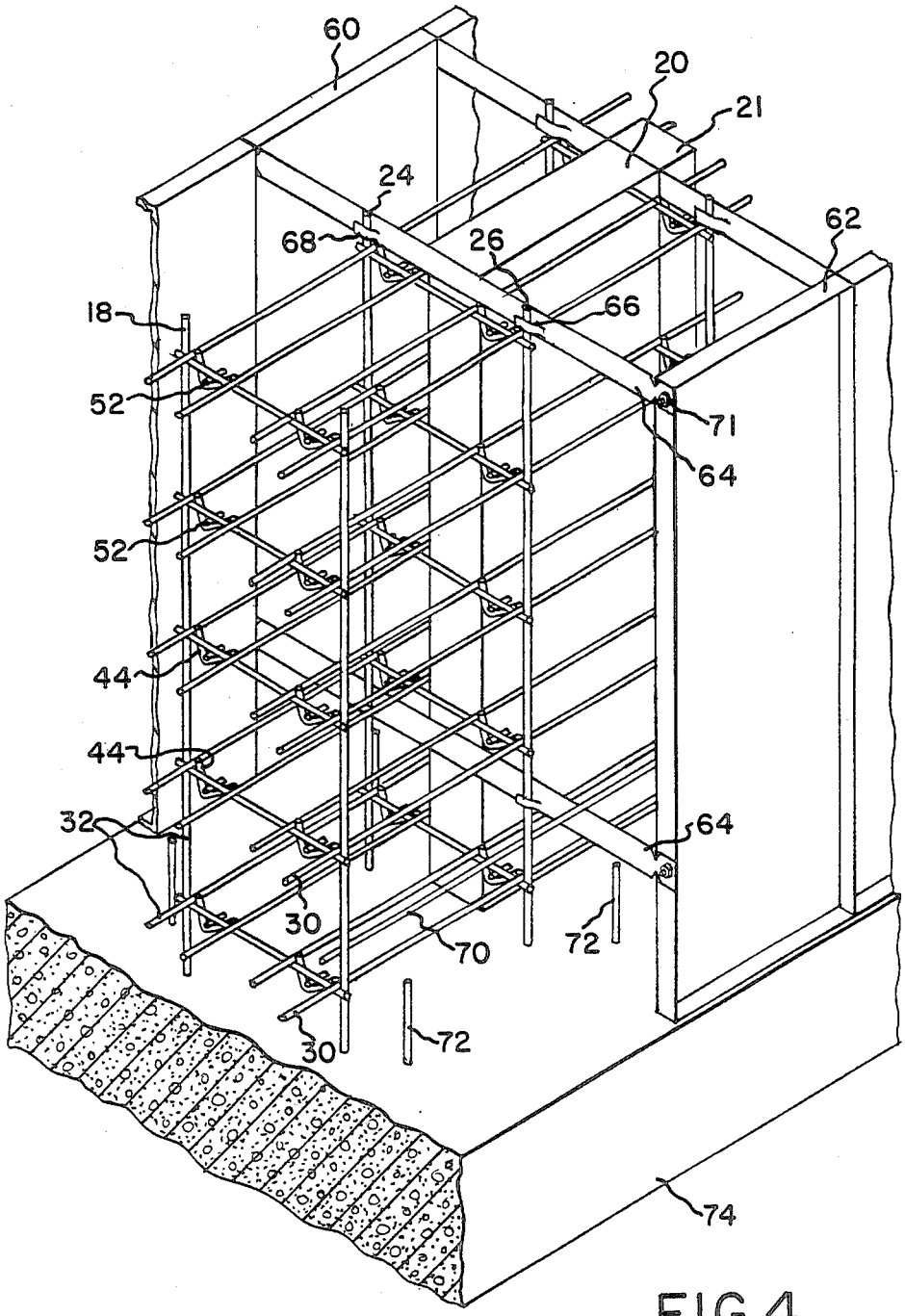
FIG. 4 is a fragmentary perspective view of the wall forms in place prior to commencing the single stage concrete pour.

In order to more clearly expose the vertical and horizontal ladder configurations, FIG. 4 is shown with an insulation panel removed from between the lattice structure on the left half of FIG. 4. It is understood that the removed panel would have been in place prior to insertion of the horizontal ladders 30,32.

The horizontal trusses 64 perform a dual purpose in this method of forming. Their primary function, as they are traditionally used, is to accurately space and maintain the forms 60,62 a fixed distance apart equal to the width W of the wall 10. However, in this embodiment of the invention, tangs 66,68, best shown in FIG. 2, are formed in the truss 64 to receive the vertical members 24,26 of the vertical ladder 18 therewithin, thus fixing the structure transversely in place, exactly medial of the wall 10. The tangs 66,68 may be of any suitable design, but the simplest is one in which the tang provides a slot of the exact width of the vertical member 24 such that the truss may be bolted through the hole 71 to one form 62 and then rotated downward to engage the vertical members 26,24 into the tangs 66,68. This precisely positions the inner lattice 72 made up of the ladders and core. It also makes subsequent positioning of the other form 60 simple and precise since the truss 64 is held in an exact perpendicular orientation to the forms 60,62 by the vertical ladder 18.

In the most convenient method for forming the inner structure of the wall prior to pouring, the first form 62 is set in place, then the insulation core panels 20,22 are positioned with the vertical ladders 18 between panels.

Once the vertical ladders 18 and the insulation core panels 20,21 are in place, the horizontal ladders 30,32 are slid into place as shown in FIG. 3. Since the vertical dimension 48 is less than the transverse dimension 46 of the horizontal ladder. the horizontal ladder is inverted for insertion such that the lengthwise rods 40,42 are vertically positioned relative to each other adjacent the insulation core. The horizontal ladder is then slid horizontally along the insulation core 12 until it spans at least two vertical ladder structures. This is shown at the top of FIG. 3. Once the horizontal ladders are correctly positioned such that the V shaped transverse members 44 are directly adjacent the cross members 28 of adjacent vertical ladders, the horizontal ladder is rotated into engagement with the outer wall 34 of the insulation core 12 and the vertical member 24 of the vertical ladder, thus forming the V shaped aperture 50 as the lengthwise rods of the horizontal ladder rest upon the cross member 28 of the vertical ladder. This is shown in the middle of FIG. 3. Lock pins 52,54 are then positioned within the aperture 50 to securely lock the horizontal ladder in position as shown at the bottom of FIG. 3. Once all horizontal ladders are positioned, the second form 60 is placed and the truss 64 is positioned and attached securely to the form 60 through the attachment hole. It has been found that the transverse dimensions of the vertical and horizontal ladder should be such that the horizontal ladder just touches the outer wall 34 of the insulation core 12. If the transverse dimension is too great it is very difficult to rotate the horizontal ladders into position against the insulation panels.

Concrete forms and insulation panels are typically provided in determinate lengths to allow for walls of varying length. Therefore, the process of positioning the first form, placing the insulated core panel, the vertical ladder, and the horizontal ladders is successively repeated along the desired horizontal length of the wall to be formed. Vertical ladders are transversely positioned between adjacent individual panels of the insulated core at spacing frequencies which are determined primarily by the degree of reinforcement and height of the wall being poured. It is noted that many rigid wall insulation panels come in two foot sections, and many concrete forms are also provided in two foot sections. Therefore, the convenient spacing for such an installation of vertical ladders would be equal to two feet. As noted earlier, the frequency of the horizontal ladders is dependent primarily upon the height of the wall being poured since the higher walls exert greater pressures on the center insulation core during concrete pouring, due to the hydrostatic weight of the concrete. In general, the vertical spacing of the horizontal ladders should be lesser in the lowest section of the wall and may be progressively greater in the upper vertical sections of the wall structure.

Upwardly extending pins 72 are provided in the previously poured foundation 74. During the concrete pour the pins 72 are encased in the concrete to securely position the wall on the foundation 74.

Once all forms are completed, concrete is poured through the upper opening between the forms to fill the spaces on opposite sides of the insulated core. This particular method of placing the insulated core provides great resistance to dislocation of the insulated core during pouring operations, nevertheless, it is desirable to uniformly pour concrete down both sides of the insulated core. Once the concrete has been poured to completely fill the forms, the concrete is allowed to set, and the forms are subsequently removed yielding a strong, monolithic insulated wall which is suitable for structural as well as curtain wall applications.

In applications where the wall height is great it may be desirable to provide additional reinforcing support to the concrete layers of the wall. This reinforcement may conveniently be provided by laying horizontal reinforcing bars 70 on the vertical ladder cross members 28 as well as on the truss 64. The reinforcing bars 70 may conveniently be placed on cross members 28 which are not fitted with horizontal ladders 30,32.

Figure 5:
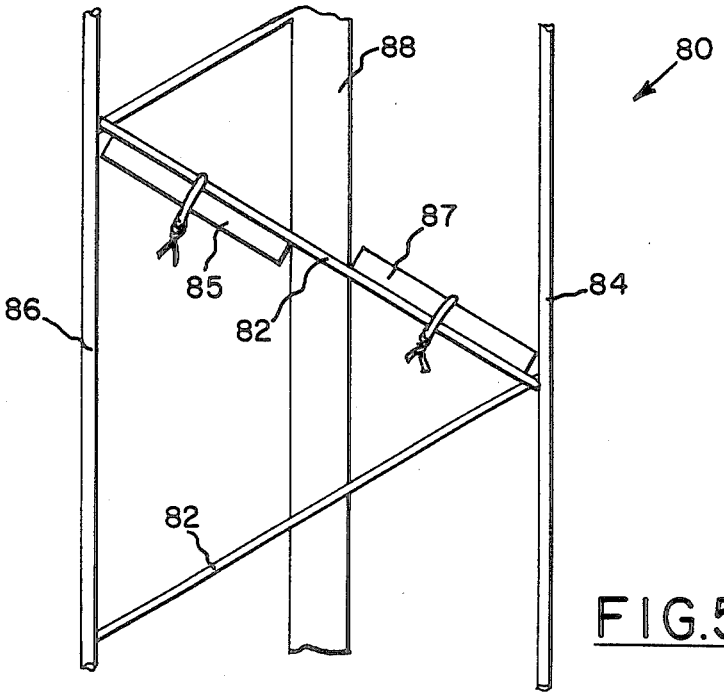
FIG. 5 shows an alternative embodiment of the vertical ladder utilizing zigzag cross members between the vertical members.

FIG. 5 shows an alternate form of the vertical ladder 80 which may be used with the invention. The ladder 80 has cross members 82 which are non-perpendicular or oblique to the pair of parallel vertical members 84,86. The zigzag cross members 82 may be used to support horizontal ladders 85,87 similar to those of FIG. 6 on both sides of the insulation core 88 of the wall.

In an alternate embodiment of the invention, the wall 10 may be prefabricated by the method just described in a location remote from the foundation. In this embodiment the prefabricated wall may be then set in place on the foundation 74.

Other modifications and changes may be envisioned and suggested by those skilled in the art; however, it is the intention of the inventor to embody within the patent all changes and modifications as reasonably and properly may come within the scope of his contribution to the art as claimed below.

I claim as my invention:

1. A monolithic concrete insulated composite wall of predetermined vertical height, horizontal length and transverse width comprising:

(a) an insulation core having a predetermined thickness and extending the full horizontal length and vertical height of said wall and having a plurality of individual insulation panels;

(b) a continuous cast, outer concrete layer on a first side of said insulation core;

(c) a continuous cast, inner concrete layer on a second side of said insulation core;

(d) a plurality of vertical ladders positioned transversely of said insulation core and extending between adjacent individual insulation panels and extending the predetermined vertical height of said wall, each vertical ladder having a pair of parallel vertical members and a plurality of cross members spaced vertically apart and rigidly connected on each end to the parallel vertical members, said vertical ladder having a width less than the predetermined transverse width of the wall and greater than the transverse width of said insulation core;

(e) a plurality of horizontal extending ladders lying in a plane perpendicular to said insulation core, said ladders being disposed in pairs on opposite sides of said insulation core and compressively positioned between said vertical members of said vertical ladder and said insulation core, each of said horizontal ladders having a vertical dimension less than the transverse dimension when positioned parallel to said cross member of said vertical ladder and having a multiplicity of openings along its horizontal length to allow communication and flow through said openings;

(f) a means for preventing vertical movement of said horizontal ladders relative to said cross member of said vertical ladder;

(g) said vertical ladder having a transverse dimension substantially equal to the thickness of the insulation core plus twice the transverse dimension of said horizontal ladders.

2. A composite wall according to claim 1 further comprising a plurality of trusses extending transversely of said wall in a plane coincident with said vertical ladders.

3. A composite wall according to claim 1 wherein said horizontal ladders comprise a pair of lengthwise extending rods connected by a plurality of V shaped transverse members affixed at opposite ends to said pair of lengthwise extending rods such that said horizontal ladder forms a V shaped cross section when viewed parallel to the transverse members, said horizontal ladders being abuttingly positioned between one vertical member of said vertical ladder and said insulation core with one of said pair of lengthwise extending rods engaged against said insulation core and said other of the pair of lengthwise extending rods being engaged against said vertical member of said vertical ladder and said plurality of transverse members of said horizontal ladders extending below the cross members of said vertical ladder to form an aperture between said cross member of said vertical ladder and said V shaped transverse member of said horizontal ladder.

4. A composite wall according to claim 3 wherein said means for preventing vertical movement of said horizontal ladder is a plurality of lock pins positioned in said aperture formed between said V shaped transverse member of said horizontal ladder and said cross member of said vertical ladder, such that when the horizontal ladder is compressively positioned between the insulation core and the vertical member of the vertical ladder and resting on the cross member of the vertical ladder, each lock pin being securely wedged between the V shaped transverse member and the cross member of said vertical ladder to prevent vertical movement of said horizontal ladder relative to said vertical ladder.

5. A composite wall according to claim 1 wherein the vertical ladder extends transversely into inner concrete layer and said outer concrete layer to provide structural reinforcement to said composite wall.

6. A composite wall according to claim 1 wherein said cross members of the vertical ladders are perpendicular to said vertical member of said vertical ladder.

7. A composite wall according to claim 1 wherein said cross members of said vertical ladders are oblique to said vertical members of said vertical ladder.

8. A composite wall according to claim 1 wherein said cross members of said vertical ladder are non-metallic rods having a thermal conductivity lower than steel.

9. The composite wall according to claim 2 wherein each of said plurality of trusses include a pair of tangs adapted to receive the vertical members of the vertical ladder and wherein the vertical members of said vertical ladders are securely held to prevent transverse movement when said truss is positioned in a vertical plane transverse to said wall.

* * * * *